US009958186B2

(12) United States Patent
Asprovski et al.

(10) Patent No.: US 9,958,186 B2
(45) Date of Patent: May 1, 2018

(54) PRESSURE RELIEF IN HIGH PRESSURE REFRIGERATION SYSTEM

(75) Inventors: Zvonko Asprovski, Liverpool, NY (US); Suresh Duraisamy, Liverpool, NY (US)

(73) Assignee: CARRIER CORPORATION, Farmington, CT (US)

( * ) Notice: Subject to any disclaimer, the term of this patent is extended or adjusted under 35 U.S.C. 154(b) by 2046 days.

(21) Appl. No.: 12/811,272

(22) PCT Filed: Jan. 17, 2008

(86) PCT No.: PCT/US2008/051303

§ 371 (c)(1),
(2), (4) Date: Jun. 30, 2010

(87) PCT Pub. No.: WO2009/091397

PCT Pub. Date: Jul. 23, 2009

(65) Prior Publication Data

US 2011/0048041 A1 Mar. 3, 2011

(51) Int. Cl.

| | |
|---|---|
| ***F25B 41/00*** | (2006.01) |
| ***F25B 9/00*** | (2006.01) |
| ***F25B 1/10*** | (2006.01) |
| ***F25B 49/00*** | (2006.01) |
| *F25B 41/04* | (2006.01) |

(52) U.S. Cl.

CPC ..... *F25B 9/008* (2013.01); *F25B 1/10* (2013.01); *F25B 49/005* (2013.01); *F25B 41/043* (2013.01); *F25B 2500/07* (2013.01); *F25B 2500/27* (2013.01); *F25B 2500/29* (2013.01); *F25B 2600/0261* (2013.01); *F25B 2600/0271* (2013.01)

(58) Field of Classification Search

USPC ..... 62/510, 196.2–196.3, 228.5

See application file for complete search history.

(56) References Cited

U.S. PATENT DOCUMENTS

| | | | |
|---|---|---|---|
| 5,363,670 | A | 11/1994 | Bartilucci |
| 5,768,895 | A | 6/1998 | Albertson et al. |
| 6,044,655 | A | 4/2000 | Ozaki et al. |

(Continued)

FOREIGN PATENT DOCUMENTS

| | | |
|---|---|---|
| JP | 2005003239 | 1/2005 |
| JP | 2006183940 | 7/2006 |

(Continued)

OTHER PUBLICATIONS

International Search Report and Written Opinion mailed Jul. 7, 2008 (8 pgs.).

(Continued)

*Primary Examiner* — David Teitelbaum

(74) *Attorney, Agent, or Firm* — Cantor Colburn LLP

(57) ABSTRACT

A $CO_2$ vapor compression system is provided with at least one pressure relief device which is designed to open when the pressure in the low pressure side exceeds the predetermined level because of exposure to high temperatures during non-operational periods. A pressure relief device is provided near the compressor suction inlet to relieve one section of the circuit and another is provided upstream of an unloading valve to relieve pressure in another section thereof.

15 Claims, 2 Drawing Sheets

(56) References Cited

U.S. PATENT DOCUMENTS

| | | | |
|---|---|---|---|
| 6,178,759 | B1 | 1/2001 | Key |
| 6,202,431 | B1 * | 3/2001 | Beaverson et al. ..... 62/196.3 |
| 7,086,244 | B2 | 8/2006 | Yamasaki et al. |
| 2006/0185380 | A1 | 8/2006 | Sienel et al. |
| 2006/0236708 | A1 | 10/2006 | Mizuno et al. |

FOREIGN PATENT DOCUMENTS

| | | | |
|---|---|---|---|
| JP | 2006327569 | | 12/2006 |
| JP | 2006329540 | | 12/2006 |
| WO | 2005066556 | A1 | 7/2005 |
| WO | 2006118573 | A1 | 11/2006 |
| WO | 2007086871 | A1 | 8/2007 |

OTHER PUBLICATIONS

International Preliminary Report on Patentability mailed Jul. 29, 2010 (6 pgs.).
European Search Report for application EP 08727825.5, dated May 24, 2016, 7pgs.

* cited by examiner

PRESSURE RELIEF IN HIGH PRESSURE REFRIGERATION SYSTEM

TECHNICAL FIELD

This invention relates generally to transport refrigeration systems and, more particularly, to a method and apparatus for relief of high pressure in a $CO_2$ refrigeration system exposed to high ambient temperature conditions.

BACKGROUND OF THE INVENTION

In transport refrigeration systems, such as refrigerated trucks, truck-trailers or refrigerated containers, during periods when the compressor is operating to compress the refrigerant in the system, substantial pressures can build up on the discharge (i.e. high pressure side) of the system. The vapor compression circuit is therefore designed to safely contain these pressures. It is recognized, however, that situations may arise where the pressures will tend to exceed what is considered a safe level. Accordingly, it is necessary to provide design features which will relieve these pressures before they become excessive.

In accordance with one established protocol, three levels of safety are provided on the high pressure side of the refrigeration system. The three levels are applied sequentially and in a prioritized fashion as follows. The first level is implemented in software and is based on pressure transducer readings. That is, when a predetermined pressure level is sensed, action is taken to limit the refrigerant flow, shut off the compressor or the system, or temporarily shut off the system and restart it after the pressure drops within a tolerance range.

A second level is implemented by way of a mechanical pressure switch which responds to sensed pressures to shut the system off or temporarily shutting the system off and restart it after a period of time.

A third level is implemented by way of a mechanical relief device which responsively opens to at least partially allow the refrigerant to be released to the atmosphere in the event that prescribed pressure levels are exceeded.

Recently concerns have arisen about the environmental effects of the release of commonly used refrigerants to the atmosphere by way of leakage and the like. One approach to addressing this problem is the use of a more benign refrigerant, $CO_2$, in place of the traditional refrigerants such as Freon. With such a refrigerant, however, it is necessary to operate at substantially higher pressures, and therefore compressors have been designed specifically for the compression of $CO_2$. With these higher pressures in the circuit, it is even more important to continuously sense these pressures and when they become excessive, provide relief in a safe manner. For that purpose, the three level protocol as described above has been found to be satisfactory to control the operating pressures on the high pressure side during operation of the system.

With the use of $CO_2$ as the refrigerant, the applicants have recognized that, in addition to the occurrence of excessive pressures during periods of operation, system pressures may also become excessive during periods of shipping and storing. That is, when a charged system at rest is exposed to excessive ambient temperature conditions, such as may occur in a warehouse in the summertime or when a system is exposed to direct sunlight at midday, the pressures are likely to rise to undesirable levels. Under these conditions, the three level safety protocol will be useful in relieving pressure on the high pressure side, but, unlike systems with conventional refrigerants in these situations, a $CO_2$ system will be susceptible to excessive pressure conditions on the low pressure side as well.

What is needed is therefore a method and apparatus for relieving pressures on the low pressure side of a $CO_2$ system which is exposed to high ambient temperature conditions during shut down.

DISCLOSURE OF THE INVENTION

In accordance with one aspect of the invention, a pressure relief device is provided on the low pressure side of a $CO_2$ vapor compression system such that, during periods in which the system is shut down but exposed to relatively high temperatures, the pressure on the low pressure side will be relieved before they reach unacceptably high levels.

In the drawings as hereinafter described, one embodiment is depicted; however, various other modifications and alternate constructions can be made thereto without departing from the spirit and scope of the invention.

DETAILED DESCRIPTION OF THE INVENTION

Figure 1:
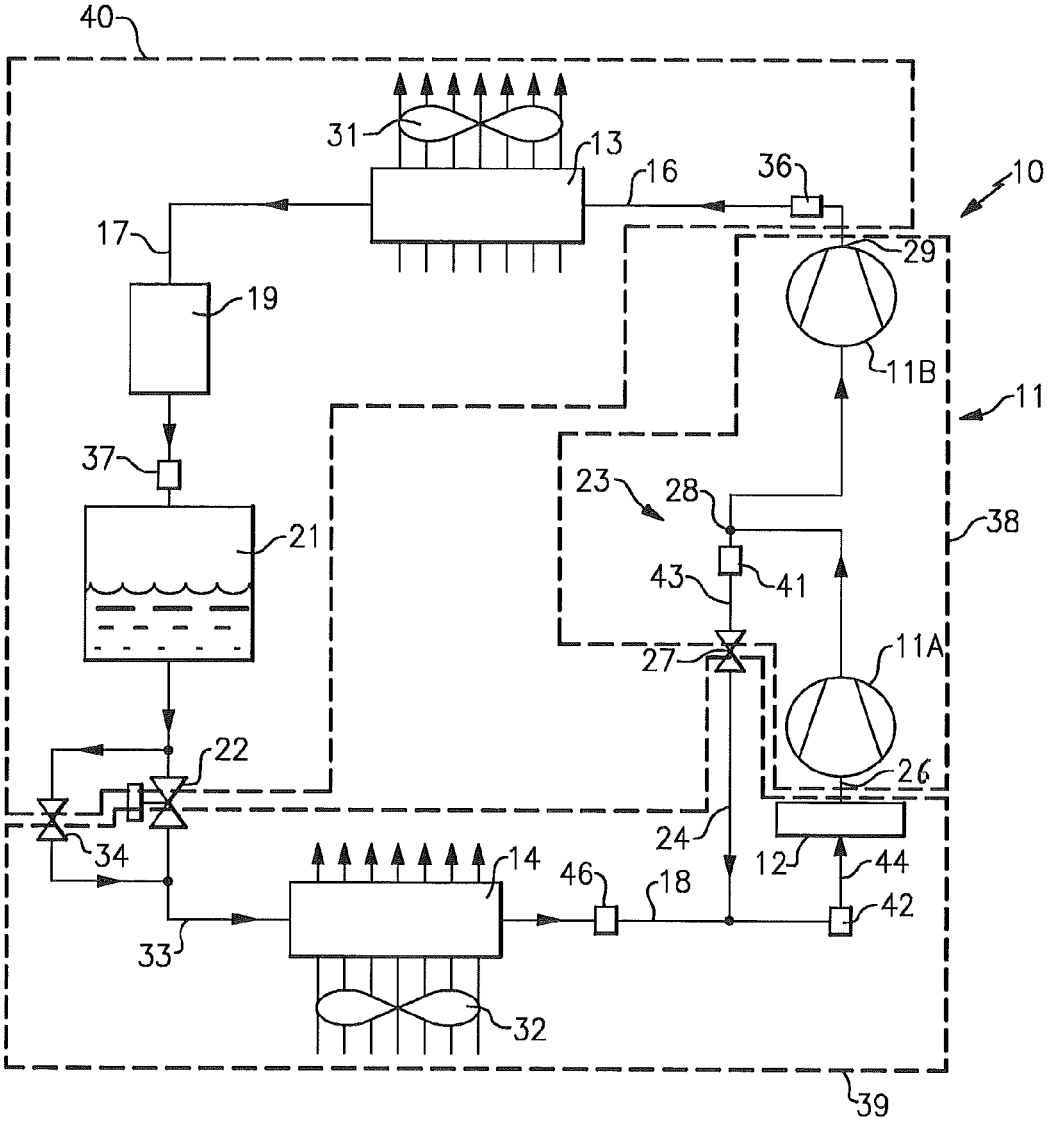
FIG. 1 is a schematic illustration of a $CO_2$ vapor compression system with the present invention incorporated therein.

Referring now to FIG. 1, the $CO_2$ refrigerant vapor compression system 10 includes a compression device 11 driven by a motor 12 operatively associated therewith, a refrigerant heat rejecting heat exchanger 13, a refrigerant heat absorbing heat exchanger 14, also referred to herein as an evaporator, all connected in a closed loop refrigerant circuit in series refrigerant flow arrangement by various refrigerant lines 16, 17 and 18. Additionally, the refrigerant vapor compression system 10 includes a filter drier 19 and a flash tank receiver 21 disposed in refrigerant line of the refrigerant circuit downstream with respect to refrigerant flow of the refrigerant heat rejecting heat exchanger 13 and upstream with respect to refrigerant flow of the evaporator 14, and an evaporator expansion device 22, operatively associated with the evaporator 14, disposed in refrigerant line downstream with respect to refrigerant flow of the flash tank receiver 21 and upstream with respect to refrigerant flow of the evaporator 14.

The compression device 11 functions to compress and circulate refrigerant through the refrigerant circuit as will be discussed in further detail hereinafter. The compression device 11 may be a single multi-stage compressor having at least a first low pressure compression stage 11A and a second high pressure compression stage 11B, such as for example a scroll compressor or a reciprocating compressor, as illustrated in FIG. 1, wherein partially compressed refrigerant from the first compression stage 11A passes to the second compression stage 11B internally within the compression mechanism of the multiple stage compressor 11. It is to be understood, however, that in another embodiment, the compression device 11 may comprise a pair of compressors 11A and 11B, such as for example a pair of reciprocating compressors or scroll compressors, having a refrigerant line connecting the discharge outlet port of the first compressor 11A in refrigerant flow communication with the suction inlet port of the second compressor 11B. In the case of a single multiple stage compressor, both compression stages would be driven by a single motor 12 operatively associated in driving relationship with the compression mechanism of the compressor 11. In the case of a pair of compressors constituting the compression device 11, each compressor will be driven independently of the other by its own dedicated motor operatively associated in driving relationship with its compression mechanism.

The refrigerant vapor compression system 10 further includes a compressor unloading circuit 23 comprising a refrigerant line 24 that interconnects an intermediate pressure point in the compression process with refrigerant line 18 of the refrigerant circuit of a point downstream with respect to refrigerant flow of the evaporator 14 and upstream with respect to refrigerant flow of the suction inlet 26 of the compression device 11, and an unloading valve 27 disposed in the refrigerant line 24 that is operative to control the flow of refrigerant through the refrigerant line 24 of the compressor unloading circuit 23. In the exemplary embodiment of the refrigerant vapor compression system depicted in FIG. 1, wherein the compression device 11 is a single compressor having at least a low pressure compression stage 11A and a high pressure compression stage 11B, refrigerant line 24 of the compressor unloading circuit 23 taps into the compression device 11 at a location 28 opening into an intermediate pressure point of the compression process, that is at a refrigerant pressure higher than the refrigerant pressure at the suction inlet to the compression device 11 and lower than the refrigerant pressure at the discharge outlet 29 of the compression device 11, and taps into the refrigerant line 18 at suction pressure.

The $CO_2$ refrigerant vapor compression system 10 is designed to operate in a subcritical cycle. Thus, the refrigerant heat rejecting heat exchanger 13 is designed to operate as a refrigerant condensing heat exchanger through which hot, high pressure refrigerant vapor discharge from the compression device 11 passes in heat exchange relationship with a cooling medium to condense the refrigerant passing therethrough from a refrigerant vapor to refrigerant liquid. The refrigerant heat rejecting heat exchanger 13, which may also be referred to herein as a gas cooler or a condenser, may comprise a finned tube heat exchanger, such as, for example, a fin and round tube heat exchange coil or a fin and flat mini-channel tube heat exchanger. In transport refrigeration system applications, the typical cooling medium is ambient air passed through the condenser 13 in heat exchange relationship with the refrigerant by means of fan(s) 31 operatively associated with the condenser 13.

The evaporator 14 constitutes a refrigerant evaporating heat exchanger which, in one form, may be a conventional finned tube heat exchanger, such as, for example, a fin and round tube heat exchange coil or a fin and mini-channel flat tube heat exchanger, through which expanded refrigerant, having traversed the expansion device 22, passes in heat exchange relationship with a heating fluid, whereby the refrigerant is vaporized and typically superheated. The heating fluid passed in heat exchange relationship with the refrigerant in the evaporator 14 may be air passed through the evaporator 14 by means of fan(s) 32 operatively associated with the evaporator 14, to be cooled and also commonly dehumidified, and thence supplied to a climate controlled environment which may include a perishable cargo, such as, for example, refrigerated or frozen food items, placed in a storage zone associated with a transport refrigeration system.

During normal operation, the compression device 11 is driven by the motor 12 to compress the $CO_2$ gas to an intermediate pressure by the first stage 11A and to a high pressure by the second stage 11B. This high pressure, which is in the normal range of 300 psi to 2250 psi (2 MPa to 15.5 MPa), is maintained throughout the entire high pressure side which includes the condenser 13, the filter drier 19, and the flash tank 21 and terminates at the expansion valve 22 where the pressure is substantially reduced. That section between the expansion device 22 and the suction inlet 26 is known as the low pressure side and includes an evaporator 14 and the downstream side of the unloading valve 27.

The expansion device 22, which is normally an electronic expansion valve, operates to control the flow of refrigerant through the refrigerant line 33 to the evaporator 14 in response to the refrigerant suction temperature and pressure sensed by the sensors (not shown) on the suction side of the compression device 11. A bypass valve 34 is provided to supplement the refrigerant flow through the expansion device 22 when higher mass flow is required by the refrigeration system.

The unloading valve 27 is selectively operated by a control (not shown) to control the flow of refrigerant through the refrigerant line 12. The unloading valve 27 is a fixed flow area valve such as, for example, a fixed orifice solenoid valve which is selectively operated in response to the refrigerant discharge temperature and pressure sensed at the discharge outlet 29. Thus the compression device 11 can be unloaded as necessary to control the refrigeration capacity of the refrigeration vapor compression system 10 by selectively opening or closing the unloading valve 27. With the unloading valve 27 in the opened position, refrigerant vapor flows out of an intermediate stage of the compression process through the refrigerant line 24 to the refrigerant line 18, rather than proceeding onward to be further compressed in the high pressure compression stage 11B. Refrigerant vapor passing through the unload circuit refrigerant line 24 returns directly to the suction side of the compression device 11, thus bypassing the high compression stage 11B and thereby unloading the compression device 11. This unloading of the compressor 11 through the compressor unload circuit 23 may be implemented in response to a high compressor discharge refrigerant temperature, or for capacity reduction or compressor power reduction.

During such operation as just described, provision is generally made to prevent the occurrence of excessive pressures on the high pressure side of the system. This is generally accomplished with a three tiered successively implemented system which includes first a software approach of responding to unusually high sensed pressures to take proper actions such as shutting down the system. If, for some reason, that does not cause a proper reduction of pressure in the high pressure side, a high pressure switch 36 comes into play to responsively take appropriate action such as shutting down the system. If the high pressure conditions still persist, the third level of safety measures is implemented by way of a pressure relief device 37 which relieves the high system pressure between the compressor discharge port 29 and the expansion valve 22. A relief device typically takes the form of a rupture disc or a pressure relief valve which simply allows a portion or the entire high pressure refrigerant vapor to escape to ambient.

It should be recognized that the three levels of measures to be taken during operation of the system relate only to the high pressure side of the system since the low pressure side is maintained at a relatively low pressure (i.e. in the range of 100 psi to 1055 psi (0.7 MPa to 7.3 MPa) as long as the compression device 11 is operating.

A problem, however, arises on the low pressure side of the system, not during operation but during periods in which the system is shut down but exposed to relatively high temperature conditions. This will be more clearly understood by reference to FIG. 2 wherein it is shown that the pressures within a closed $CO_2$ system (which is true of the low pressure side when the system is at rest), can become excessive as the temperatures are increased.

Figure 2:
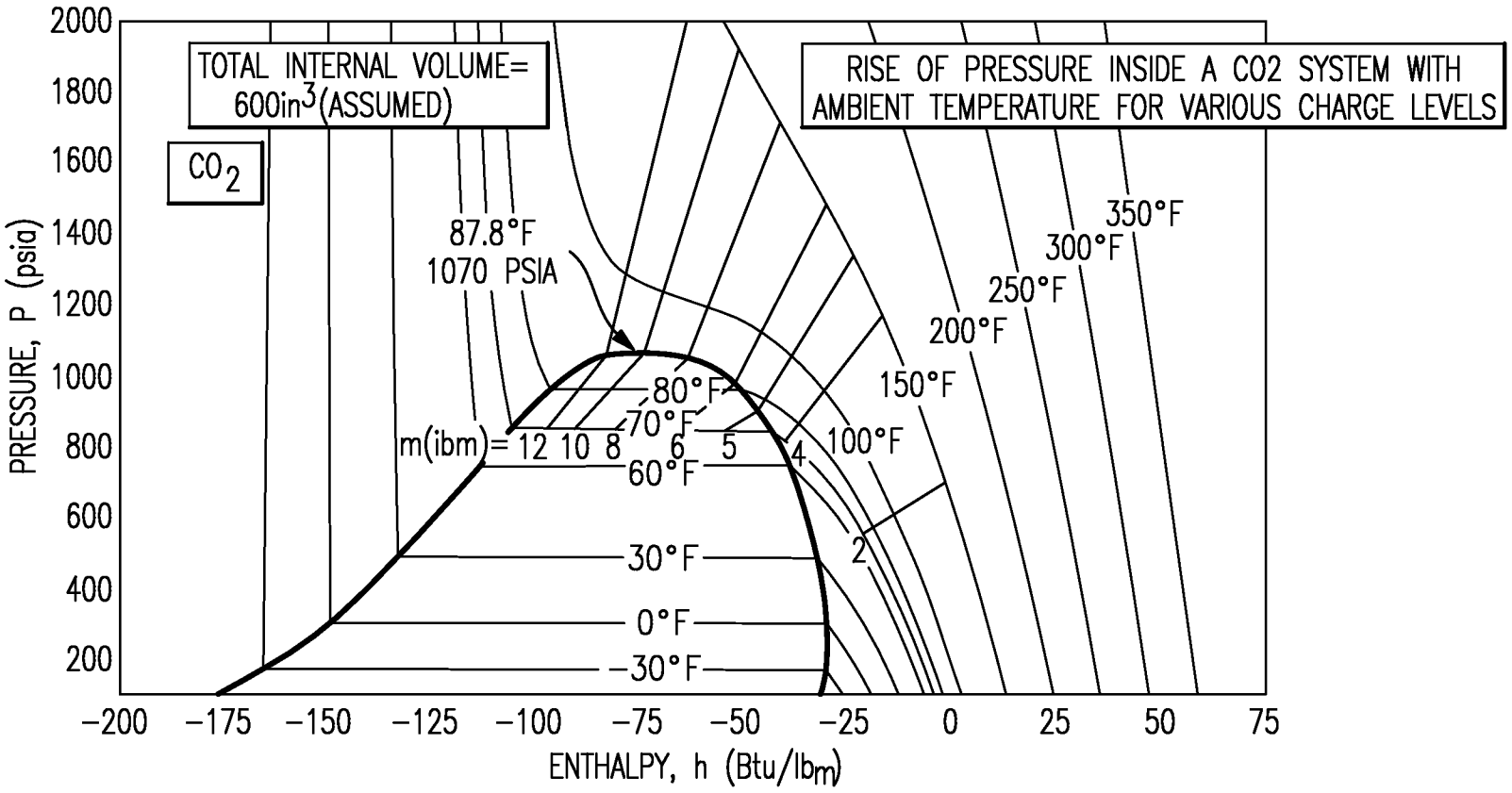
FIG. 2 is a graphic illustration of the pressures inside a $CO_2$ system as a function of ambient temperature and charge levels.

The FIG. 2 data is based on the assumption that the total internal volume is 600 cubic inches. The lines represent ambient temperatures and the level of charge of $CO_2$in lbm (mass pounds). It will thus be seen, for example, that at 70° F., for any of the charge levels 2 lbm to 8 lbm, the resulting pressures remain within an acceptable level. However, as the ambient temperature rises to 150° F., for example, which is quite possible when a unit is sitting in the sunlight on a hot summer day, then the pressure levels rise to unacceptable levels.

A summary of the values for 70° F. and 150° F. for charges 2 $lb_m$ to 8 $lb_m$ are shown in Table I below.

TABLE I

| $CO_2$ Charge (lbm) | Pres at 70° F. Ambient (psi) | Pres at 150° F. Ambient (psi) |
|---|---|---|
| 2 | 550 | 700 |
| 4 | 820 | 1150 |
| 5 | 850 | 1350 |
| 6 | 850 | 1490 |
| 8 | 850 | 1710 |

It will thus be seen that the maximum pressures that will be reached when the ambient temperature is at 70° is 850 psi which is acceptable for such a system. However, when the temperature rises to 150° F., the pressures rise from 700 psi for 2 lbm to 1710 for 8 lbm such pressures are considered to be too high. In this regard, since the low pressure side of the system is normally constructed to operate at the relatively low range of 100 psi to 1055 psi (0.7 MPa to 7.3 MPa), it is preferable to not exceed 1055 psi (7.3 MPa) on the low pressure side.

Referring now back to FIG. 1, let us consider the operation of various components, specifically the unloading valve 27 and the expansion device 22.

For purposes of reliability and safety, the unloading valve 27 is a normally closed valve such that, when the system is shut down, the valve 27 is closed. At the same time during shut down, the first and second stages 11A and 11B are both non-operational and therefore in their closed positions. The result is that, that part of the circuit between the first stage 11A and the second stage 11B, including the upstream side of unloading valve 27, is a closed space with $CO_2$ refrigerant trapped therein and subject to the high pressure phenomenon as discussed hereinabove with respect to FIG. 2 and Table I. For illustrative purposes, this section is delineated by the line 38 in FIG. 1.

Considering now the expansion device 22 and its bypass valve 34, when the system is shut down, these two are in a closed position to prevent refrigerant migrating to the evaporator coil and the suction side of compressor which would affect the reliability and reduce the compressor useful life. Accordingly, there is another section, i.e. between the expansion device and the suction inlet 26 that is now a closed space that is subject to the high pressure phenomenon as discussed hereinabove. For illustrative purposes, this section is delineated by the line 39. Finally, because of the closed condition at the discharge outlet 29 on the one end and the expansion device 22 on the other end, the section therebetween, a delineated by line 40, is also a closed section that is susceptible to elevated pressures when exposed to high temperatures. However, it should be recognized that this is the high pressure side which already includes provisions for relief of high pressure in the way of the high pressure relief device 37. Accordingly, no special provision needs be made to that section. However, the sections shown at 38 and 39 do require the addition of features that would not ordinarily be included. Thus, a high pressure relief device 41 is placed in line 43, upstream of the unloading valve 27 and a high pressure relief device 42 is placed in line 44 upstream of the suction inlet 26 as shown. The relief device 41 and 42 can be in the form of rupture discs or pressure relief device which, when exposed to excessive temperatures will rupture and release the high pressure gas to the atmosphere. In this way, the high pressure relief device 41 will act to relieve any excessive pressure in the section of the circuit shown at 38 and the relief device 42 will act to relieve any excessive pressure that may exist in that portion of the circuit shown at 39. As an example, an appropriate pressure level that the relief devices 41 and 42 might be designed to open would be in the range of 1300 psi to 2500 psi (9 MPa to 17.2 MPa).

In addition to the high pressure relief device 42, that section shown at 39 would preferably also include a high pressure switch 46 that would take precedent over the relief device 42 such that the high pressure switch 46 would open before the relief device 42 would open.

Although the present invention has been particularly shown and described with reference to one embodiment as illustrated in the drawings, it will be understood by one skilled in the art that various changes in detail may be made thereto without departing from the spirit and scope of the invention as defined by the claims.

We claim:

1. A vapor compression system comprising:

a refrigerant circuit having in serial flow relationship at least one compressor for compressing $CO_2$ vapor as a refrigerant, a heat rejecting heat exchanger, an expansion device, and a heat absorbing heat exchanger;

a compressor unloading circuit fluidly interconnecting an intermediate stage of said at least one compressor to a low pressure point between said heat absorbing heat exchanger and a suction inlet of said at least one compressor, said low pressure point being downstream of the heat absorbing heat exchanger and upstream of the suction inlet of said at least one compressor, said compressor unloading circuit including an unloading valve; and at least one pressure relief device disposed between said unloading valve and said intermediate stage for relieving pressure in said compressor unloading circuit during periods in which the system is not operating but is exposed to relatively high temperature conditions.

2. A vapor compression system as set forth in claim 1 wherein said at least one compressor includes two stages.

3. A vapor compression system as set forth in claim 1 wherein said at least one compressor comprises two compressors connected in series.

4. A vapor compression system as set forth in claim 1 wherein said at least one pressure relief device comprises a rupture disc.

5. A vapor compression system as set forth in claim 1 wherein said at least one pressure relief device comprises a pressure relief valve.

6. A vapor compression system as set forth in claim 1 and including a high pressure switch disposed on said low pressure side of said refrigerant circuit, said high pressure switch being designed to open at a pressure lower than the pressure at which said at least one pressure relief device is adapted to release pressure.

7. A vapor compression system as set forth in claim 1 wherein said unloading valve comprises a normally closed valve.

8. A vapor compression system as set forth in claim 1 wherein the at least one pressure relief device disposed downstream of said intermediate stage and upstream of said unloading valve.

9. A method of preventing the occurrence of undesirable high pressures in a $CO_2$ vapor compression system when exposed to high temperature ambient conditions during shut down, wherein said vapor compression system includes at least one compressor and a compressor unloading circuit fluidly interconnecting an intermediate stage of said at least one compressor to a low pressure point between a heat absorbing heat exchanger and a suction inlet of said at least one compressor, said low pressure point being downstream of the heat absorbing heat exchanger and upstream of the suction inlet of said at least one compressor, said compressor unloading circuit including an unloading valve, the method comprising:

providing at least one pressure relief device disposed between said unloading valve and said intermediate stage, said at least one pressure relief device being adapted to open when the pressure in said compressor unloading circuit upstream of said unloading valve reaches a predetermined level.

10. A method as set forth in claim 9 wherein said at least one compressor includes two stages.

11. A method as set forth in claim 9 wherein said at least one compressor comprises two compressors connected in series.

12. A method as set forth in claim 9 wherein said at least one pressure relief device comprises a rupture disc.

13. A method as set forth in claim 9 wherein said at least one pressure relief device comprises a pressure relief valve.

14. A method as set forth in claim 9 further comprising installing a high pressure switch on said low pressure side of said refrigerant circuit, said high pressure switch being adapted to open at a pressure lower than the pressure at which said at least one pressure relief device is adapted to release pressure.

15. A method as set forth in claim 9 wherein said unloading valve comprises a normally closed valve.

* * * * *